US007431809B2

(12) United States Patent
Mizuno et al.

(10) Patent No.: US 7,431,809 B2
(45) Date of Patent: Oct. 7, 2008

(54) ELECTRODE FOR A CATHODIC PROTECTION DEVICE

(75) Inventors: Masahiro Mizuno, Shizuoka-ken (JP); Yuji Tateishi, Shizuoka-ken (JP); Toshiyuki Mizushima, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 132 days.

(21) Appl. No.: 11/389,000

(22) Filed: Mar. 24, 2006

(65) Prior Publication Data

US 2006/0213768 A1 Sep. 28, 2006

(30) Foreign Application Priority Data

Mar. 24, 2005 (JP) ..... 2005-085528

(51) Int. Cl.
*C23F 13/08* (2006.01)

(52) U.S. Cl. ..... 204/196.37; 204/196.34; 204/196.18; 204/196.19; 440/88 C; 440/88 R; 440/80

(58) Field of Classification Search ..... 204/196.18, 204/196.19, 196.34, 196.37; 440/80, 88 C, 440/88 R See application file for complete search history.

(56) References Cited

U.S. PATENT DOCUMENTS

| | | | | |
|---|---|---|---|---|
| 3,953,742 | A | 4/1976 | Anderson et al. | |
| 4,570,477 | A * | 2/1986 | Sugibuchi | 73/40.5 R |
| 6,319,080 | B1 | 11/2001 | Watanabe et al. | |
| 6,559,660 | B1 | 5/2003 | Staerzl | |
| 2003/0232486 | A1 * | 12/2003 | Mashino | 438/455 |
| 2004/0246656 | A1 * | 12/2004 | Kirsten | 361/306.3 |

FOREIGN PATENT DOCUMENTS

| | | |
|---|---|---|
| JP | 06-299377 | 10/1994 |
| JP | 2572785 | 3/1998 |

* cited by examiner

*Primary Examiner*—Bruce F Bell
(74) *Attorney, Agent, or Firm*—Knobbe Martens Olson & Bear

(57) ABSTRACT

An electrode for a cathodic protection device that has one or more electrode bodies formed of a conductive wire. The electrode includes a pair of films made of an insulating material which are bonded to each other while sandwiching the electrode body therebetween. Preferably at least one of the pair of films is bonded to an engine body. The electrode body is exposed to the outside through one or more through-holes formed in at least one of the films. The electrode is less susceptible to short-circuiting or wire breakage when bent and is also easier to manufacture than conventional electrodes.

5 Claims, 4 Drawing Sheets

ELECTRODE FOR A CATHODIC PROTECTION DEVICE

RELATED APPLICATIONS

The present application is based on and claims priority under 35 U.S.C. § 119(a)-(d) to Japanese Patent Application No. 2005-085528, filed on Mar. 24, 2005, the entire contents of which are hereby expressly incorporated by reference herein.

BACKGROUND OF THE INVENTION

1. Field of the Invention

The present invention relates to an impressed current cathodic protection system for a marine engine and to an electrode therefor. The cathodic protection system preferably provides a protective current flow through a coolant passage.

2. Description of the Related Art

A conventional outboard motor engine often uses sea water as cooling water and is equipped with a cathodic protection device for preventing electrolytic corrosion. Known cathodic protection devices include impressed current type devices having an electrode connected to a battery. The electrode is located upstream of the engine in a cooling water passage and provides a cathodic protection current into the cooling water. The electrode serves as an anode and the engine serves as a cathode. Although corrosion protection is provided near the electrode, this arrangement does not provide corrosion protection to areas in contact with a relatively thin cooling water passage inside the engine.

Cathodic protection devices employing an impressed current system are used for non-engine applications. An exemplary structure includes a linear cathodic protection electrode that passes through a water conduit or pipe. A cathodic protection current flows from the cathodic protection electrode to the wall of the conduit.

The cathodic protection electrode is formed by a strand of fine monofilament yarn wrapped a metal wire. Since the electrode is formed by winding a string around a metal wire, the linear cathodic protection electrode is costly to manufacture.

SUMMARY OF THE INVENTION

One aspect of the present invention involves the recognition that prior impressed cathodic protection electrodes are ill suited for use with engines. For instance, to insert a cathodic protection electrode into a cooling water passage having a complex shape, the electrode must be bent at many locations. The bends result in gaps forming between the windings of the string to expose the electrode wire. Accordingly, such a design is not suitable for use in the complex shaped cooling passage of an engine. Contact or rubbing between the exposed metal at the bent locations of the electrode and the wall of the cooling water passage may cause short-circuiting or wire breakage.

Another aspect of the present invention is directed toward addressing one or more of the above noted problems and provides an electrode for a cathodic protection device, which is less susceptible to short-circuiting or wire breakage when bent and is easier to manufacture than convention electrodes.

In accordance with an additional aspect of the invention, an electrode for a cathodic protection device is provided. The electrode is configured to be immersed in water and connected to a power source. The electrode comprises an electrode body formed from a conductive wire and a pair of films made of an insulating material and bonded to each other while sandwiching the electrode body therebetween, at least one of the pair of films having at least one opening extending therethrough to expose at least a portion of the electrode body.

In some embodiments the pair of films can be formed in a band-like configuration. The electrode body also can extend in a direction parallel to the pair of films. A large number of through-holes formed in one or more of the films can additionally be used to expose the electrode body to the coolant. The pair of films can be bonded to each other with an adhesive. The pair of films and the adhesive may be heat resistant, and together can be inserted into a cooling water passage of a marine engine.

Another aspect of the invention involves an electrode configured to be immersed in coolant water and connected to a power source. The electrode comprises a first insulating film portion, a second insulating film portion, at least a part of the second insulating film portion being bonded to at least a part of the first insulating film portion, the second insulating film portion having at least one opening, and at least one conductive wire arranged between the first and second insulating portions so that at least a portion of the conductive wire is exposed through the at least one opening when the first insulating film portion is bonded to the second insulating film portion.

Yet another aspect of the invention involves a marine engine that comprises a coolant passage configured to flow coolant, an electrode configured to be immersed in the coolant and connected to a power source, the electrode having a conductive wire, a first insulating portion, a second insulating portion bonded to the first insulating portion, and at least one opening. The conductive wire is arranged between the first and second portions so that at least a portion of the conductive wire is exposed through the at least one opening. In some embodiments at least a part of at least one of the insulating portions is attached to the engine.

The electrode body is insulated from the wall of the coolant passage by at least one of the pair of films. The cathodic protection current flows through water entering the through-holes of the film. Since the opening width of the through-holes is constant, even when the films are bent, the exposed areas of the electrode body do not substantially increase in size even when the films are in a curved configuration. Therefore, an advantage of the electrode is that when the electrode is bent it is less susceptible to short-circuits and wire breakage.

Another advantage of the electrode is that it is easily inserted into a thin water passage, reduces the water resistance, and provides protection over the entire portion of the water passage. Therefore, the electrode can be readily mounted in a thin, narrow cooling water passage, such as the cooling water passage of an outboard motor engine, to thereby provide corrosion protection for the engine.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments" one will understand how the features of the system and methods provide several advantages over conventional electrodes.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF THE PREFERRED EMBODIMENTS

The following detailed description is now directed to certain specific embodiments of the invention. However, the invention can be embodied in a multitude of different systems and methods. In this description, reference is made to the drawings wherein like parts are designated with like numerals throughout.

The following description is for the exemplary case where an electrode 2 for a cathodic protection device is mounted in a cooling water passage of a marine engine. While the embodiment described in connection with FIGS. 1 through 4 is directed to an exemplary cathodic protection electrode for an outboard engine, the cathodic protection electrode may be used in any water passage that is subject to corrosion. For instance, the cathodic protection electrode 2 may be used in a water pipe or the like.

Figure 1:
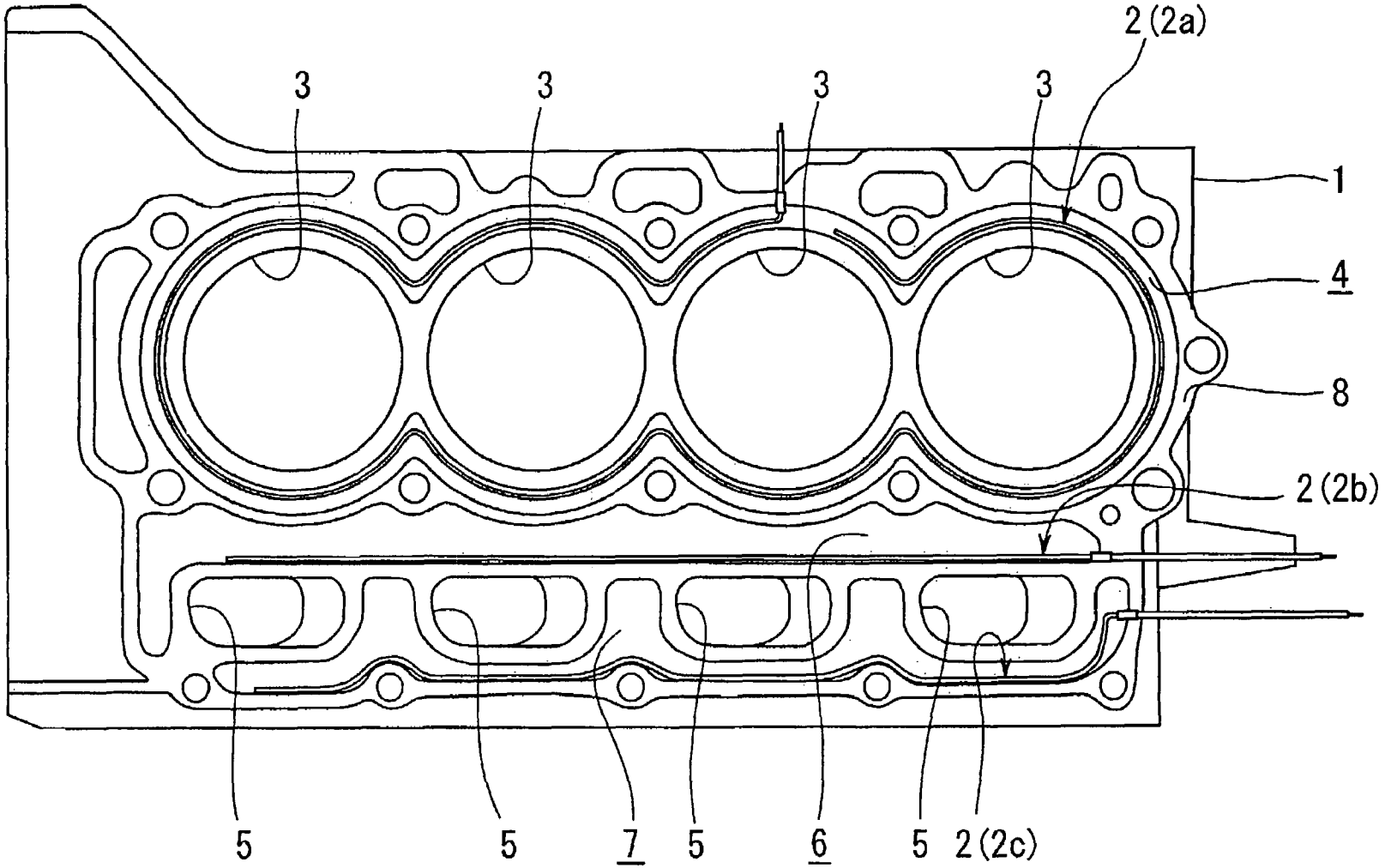
FIG. 1 is a plan view of a cylinder body having a plurality of electrodes, which are configured in accordance with a preferred embodiment of the present invention, located within coolant passages of the cylinder body.
Figure 2:
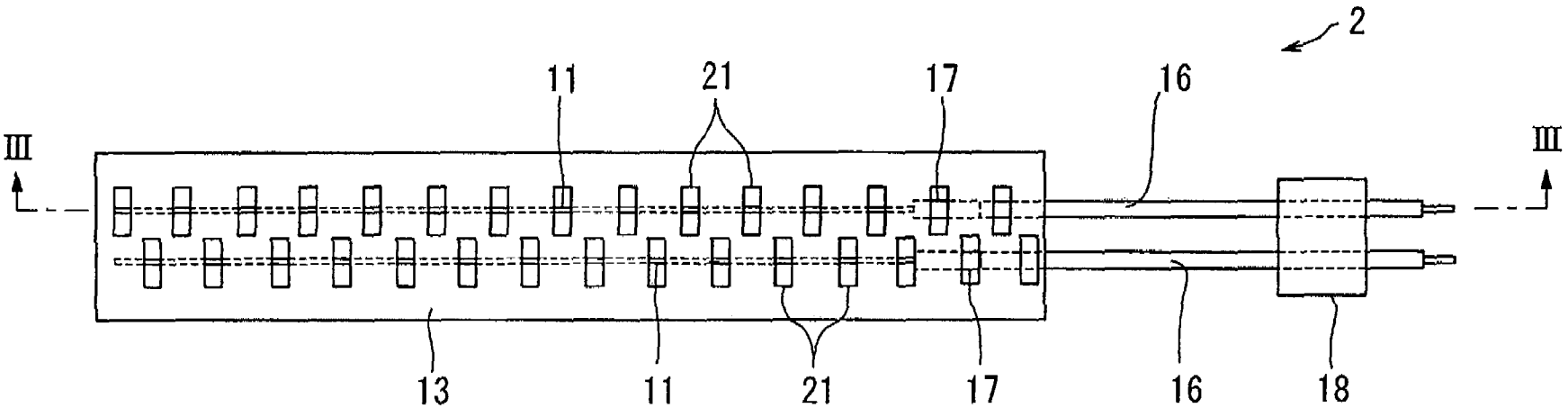
FIG. 2 is a front view of one of the plurality of electrodes from FIG. 1.
Figure 3:
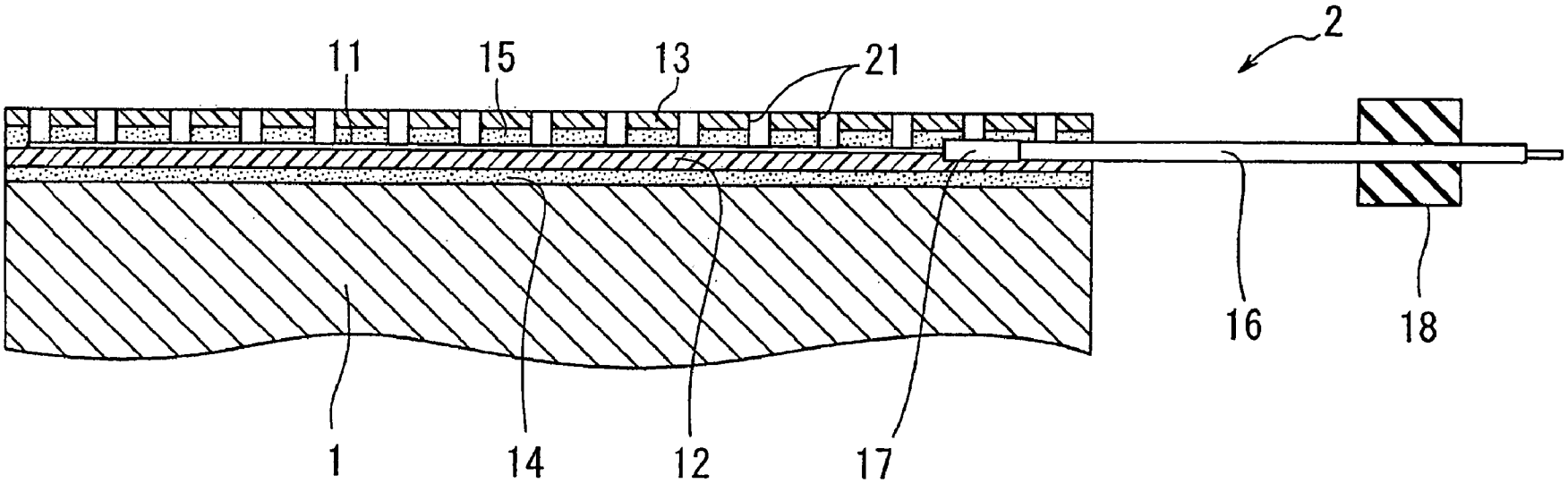
FIG. 3 is a cross section of the electrode from FIG. 2 taken along line III-III and mounted to a surface of a coolant passage within an engine.
Figure 4:
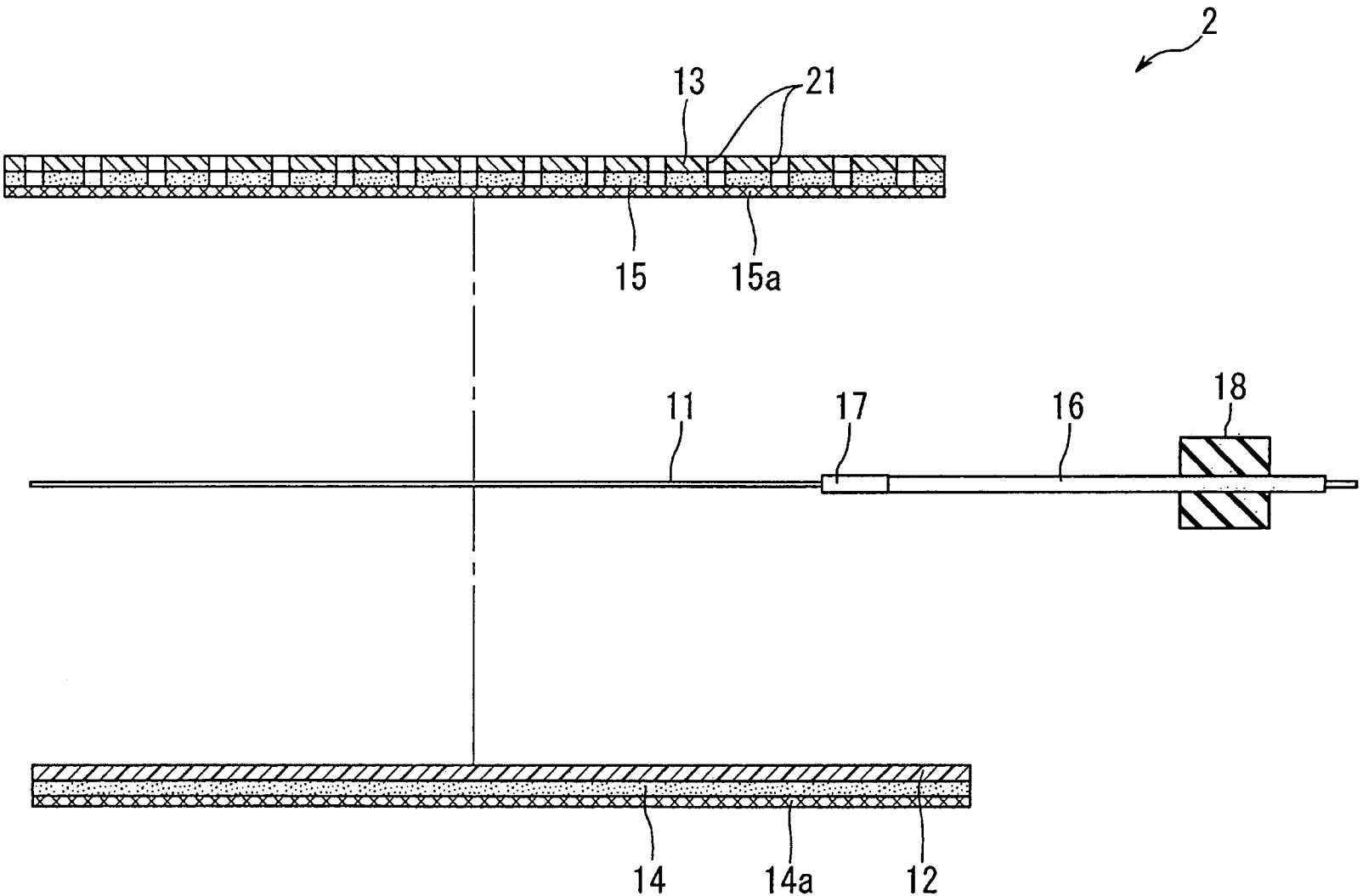
FIG. 4 is an exploded cross-section of the electrode from FIG. 1.

FIG. 1 is a plan view of a cylinder body 1 to which a plurality of electrodes for a cathodic protection device according to the present invention is mounted. FIG. 2 is a front view of the electrode from FIG. 1. FIG. 3 is a cross section of the electrode from FIG. 2 mounted to the engine. FIG. 4 is an exploded cross section of the electrode from FIG. 1.

The exemplary cylinder body 1 is a four-cylinder engine having first, second and third coolant passages 4, 6, and 7, respectively. The first coolant passage 4 is formed around the cylinder holes 3 of the cylinder body 1. The second coolant passage 6 is formed between the cylinder holes 3 and exhaust ports 5. The third coolant passage 7 is formed around the exhaust ports 5.

A mating face 8 of the cylinder body 1 is configured to mate with a cylinder head (not shown). The coolant passages 4, 6, 7 are open in a direction toward the cylinder head. Coolant passages in the cylinder head connect with the coolant passages 4, 6, 7 of the cylinder body 1 when the cylinder head is fixed to the cylinder body 1. The cathodic protection electrodes 2 are mounted in each of the first to third cooling water passages 4, 6, and 7.

As shown in FIGS. 2, 3, and 4, the cathodic protection electrode 2 includes an electrode body 11, a base film 12, and a laminate film 13. The base film 12 and the laminate film 13 preferably sandwich the electrode body 11 therebetween. An adhesive 14, 15 bonds the components together. The electrode body 11 may be formed from a platinum wire. The electrode 2 may be manufactured from a single laminate film folded around the electrode body.

In FIGS. 2 through 4, the size of the electrode body 11, the thicknesses of the films 12 and 13 and adhesives 14 and 15 are depicted as being larger than their actual dimensions. It should be noted that while this embodiment has the base film 12 bonded to the laminate film 13 with adhesive 15, the two films 12 and 13 may be bonded together by other means, for example, heat welding or the like.

A single cathodic protection electrode 2 comprises one or more electrode bodies 11. The cathodic protection electrode 2 illustrated in FIG. 1 includes two parallel electrode bodies 11 located between the pair of films 12 and 13. Each of the electrode bodies 11 extends parallel to the pair of films 12 and 13 and has a distal end portion that protrudes beyond the ends of the films 12, 13 as illustrated on the right-hand sides of FIGS. 2, 3, and 4.

Each distal end portion of the two electrode bodies 11 may be inserted through a protective pipe 16. The protective pipe 16 may be formed from a synthetic resin and include a heat-shrinkable tube 17. The synthetic resin material forming the protective pipe 16 preferably is heat resistant and has insulating properties such that the protective pipe 16 is less susceptible to degeneration when in contact with the cylinder body 1. The heat-shrinkable tube 17 is heat shrinked around the electrode main body 11 and the distal or left most end portion of the pipe 16 to seal the protective pipe 16. The heat-shrinkable tube 17 and the distal end portion of the protective pipe 16 are bonded together while being sandwiched between the base film 12 and the laminate film 13.

The proximal or left most end portions of the two assemblies, each constructed from an electrode main body 11 and a protective pipe 16, extend through a single rubber-made support member 18. As shown in FIG. 2, the support member 18 holds the proximal ends of the two assemblies generally parallel to each other. As shown in FIGS. 2 and 3, the distal end portions of the two assemblies, including the distal end portions of the protective pipes 16, are sandwiched between the base film 12 and the laminate film 13.

The base film 12 and the laminate film 13 each may be formed in a band-like configuration from left to right in FIG. 2. The synthetic resin material forming the base and laminate films 12, 13 preferably is heat resistant and has insulating properties such that the films are not susceptible to degeneration when subjected to the temperature of the engine cooling water. For example, the films 12 and 13 may be formed of fluororesin or the like. The films 12 and 13 are inserted into each of the first to third cooling water passages 4, 6, and 7 in an erected state so that a widthwise direction of the films 12, 13 is parallel to the axial direction of the cylinder.

In the illustrated embodiment, both the obverse and reverse surfaces of the base film 12 is flat without holes. An adhesive 14 bonds the base film 12 to a wall surface or the like of the cooling water passage 4, 6, and 7. The adhesive 14 may be formed in a layer-like fashion over the entire reverse surface (the surface on the side opposite to the laminate film 13) of the base film 12. Preferably, the material for the adhesive 14 may be repeatedly used in sea water and in fresh water at temperatures within the range of, for example, 100 degrees C. to −40 degrees C. As shown in FIG. 4, the adhesive 14 has a release paper 14*a* affixed onto its adhesive surface. The release paper 14*a* is peeled off to expose the adhesive 14 to bond the base film 12 to the above-mentioned wall surface.

As shown in FIG. 2, the laminate film 13 has a large number of through-holes 21 over the two electrode main bodies 11. Each through-hole 21 may be rectangular in shape and open in both the obverse and reverse surfaces of the laminate film 13 so as to extend through the laminate film 13. Further, for embodiments having a plurality of through-holes 21, the through-holes 21 may be equally spaced in one or more rows on the laminate film 13 and align with the two electrode bodies 11.

Since two electrode bodies 11 are provided in the embodiment illustrated in FIG. 2, the through-holes 21 are preferable formed in at least two rows. Of course other arranges and shapes of the holes are within the scope of the invention. As illustrated in FIG. 2, the two rows of through-holes 21 may be offset from each other in the longitudinal direction. In the illustrated embodiment, the two rows are offset a half pitch from each other in the longitudinal direction.

Further, the adhesive 15 that bonds the laminate film 13 onto the electrode body 11 and the base film 12 may be applied in a layer-like fashion over the entire reverse surface (the surface on the side opposite to the base film 12) of the laminate film 13. The adhesive 15 may or may not be the same adhesive 14 used on the base film 12. Preferable the adhesive 15 is applied onto the reverse surface of the laminate film 13 but not at the locations of the through-holes 21. As shown in FIG. 4, a release paper 15*a* may be affixed over the adhesive 15.

The cathodic protection electrode 2 illustrated in FIG. 4 may be assembled by bonding two electrode bodies 11 to the laminate film 13 using the adhesive 15. The electrode bodies 11, the protective pipe 16, and the support member 18 may be assembled prior to bonding the electrode bodies 11 to the laminate film 13. The electrodes 11 are preferably aligned with the though-holes 21 of the laminate film 13 so that once assembled, at least a portion of the electrode body is exposed through the through-hole 21.

The assembled laminate film 13 and electrode bodies 11 are bonded to the base film 12 using the adhesive 15. In this way, the electrode bodies 11 are sandwiched between the pair of films 12, 13. The support member 18 may be attached to the electrode bodies 11 after the films 12, 13 are bonded together.

As shown in FIG. 1, the lengths of the three cathodic protection electrodes 2*a*, 2*b*, 2*c* may be selected in accordance with the lengths of the first to third cooling water passages 4, 6, and 7, respectively.

As seen from the cylinder head side, the first cathodic protection electrode 2*a* is bent to conform to the shape of the first cooling water passage 4 and surrounds the periphery of the cylinder holes 3. The first cathodic protection electrode 2*a* is bent so that the principal surfaces of both films 12, 13 become the inner and outer sides. The first cathodic protection electrode 2*a* according to this embodiment is formed in a so-called unicursal manner so as to extend over the entire opening area of the first cooling water passage 4. As shown in FIG. 1, the first cathodic protection electrode 2*a* is bonded to the wall of the first cooling water passage 4 that is closest to the cylinder hole 3 by means of the adhesive 14. Alternatively, the first cathodic protection electrode 2*a* may be bonded to the wall surface of the first cooling water passage 4 on the side farthest from the cylinder holes 3.

The second cooling water passage 6 has a linear shape and is aligned parallel with the cylinder holes 3. The second cathodic protection electrode 2*b* has a linear shape and is inserted in the second cooling water passage 6. The second cathodic protection electrode 2*a* may be bonded to the wall of the cooling water passage 6 that is on the exhaust port 5 side by means of the adhesive 14. Alternatively, the second cathodic electrode 2*b* may be bonded to the wall surface of the second cooling water passage 6 on the side opposite from the exhaust ports 5.

The third cooling water passage 7 surrounds the outside of the exhaust ports 5 (the lower portion of FIG. 1). As seen from the cylinder head side, the third cathodic protection electrode 2*c* is bent to conform to the shape of the third cooling water passage 7. The third cathodic protection electrode 2*c* is bent so that the principal surfaces of both films 12, 13 become the inner or outer side. As shown in FIG. 1, the third cathodic protection electrode 2*c* is bonded to the outer wall of the third cooling water passage 7 by means of the adhesive 14. Alternatively, the third cathodic protection electrode 2*c* may be bonded to the inner wall surface of the third cooling water passage 7.

As shown in FIG. 1, an end portion of each of the first to third cathodic protection electrodes 2*a*, 2*b*, 2*c* extends outside the cylinder body 1. The end portions are connected to an electric power supply and a control device (not shown). A structure may be employed to seal the passages through which the electrodes extend between the inside and outside of the cylinder body 1. For example, the support member 18 may be tightly fitted to the cylinder body 1 or the cylinder head.

Further, the pair of films 12, 13, insulates the electrode bodies 11 from the walls of the first to third cooling water passages 4, 6, and 7. The cathodic protection current flows through water entering the through-holes 21 of the laminate film 13. The size of the openings of the through-holes 21 do not substantially increase in size when the films 12 and 13 are bent. The cathodic protection electrode 2 is less susceptible to short-circuiting or breaking when the electrode is bent to match the shape of a coolant passage.

The cathodic protection electrode 2 may be inserted into thin, narrow cooling water passages such as the cooling water passages 4, 6, and 7 to provide reliable protection against corrosion of the engine.

The reliability of a cathodic protection electrode 2 having a plurality of electrode bodies 11 is improved since only one of the plurality of bodies 11 is necessary to provide the cathodic protection current in the event the other body(ies) 11 break.

Further, in embodiments having a plurality of bodies 11, the through-holes 21 may be formed in two rows. Of course other arranges and shapes of the holes are within the scope of the invention. As illustrated in FIG. 2, the two rows of through-holes 21 may be offset from each other in the longitudinal direction. In the illustrated embodiment, the two rows are offset a half pitch from each other in the longitudinal direction. With this arrangement, the bending stress exerted upon the cathodic protection electrode 2 may be dispersed across the laminate film 13 to reduce the likelihood that the electrode body 11 will be broken at the bend location.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A marine engine comprising;

a coolant passage configured to flow coolant;

an electrode configured to be immersed in the coolant and connected to a power source, the electrode having a conductive wire, a first insulating portion, a second insulating portion bonded to the first insulating portion, and at least one opening; and wherein the conductive wire is disposed between the first and second portions so that at least a portion of the conductive wire is exposed through the at least one opening.

2. The marine engine according to claim 1, wherein the first insulating portion and the second insulating portion together form a continuous single insulating film folded upon itself.

3. The marine engine according to claim 1, wherein the first insulating portion is attached to an inside surface of the coolant passage.

4. The marine engine according to claim 1, wherein the electrode is bent so as to conform to a bend in the coolant passage.

5. The marine engine according to claim 1, wherein the first and second insulating portions are bonded to each other with an adhesive.

* * * * *